United States Patent [19]

Shiga et al.

[11] Patent Number: 4,604,169

[45] Date of Patent: Aug. 5, 1986

[54] PROCESS FOR METAL PLATING A STAINLESS STEEL

[75] Inventors: Shoji Shiga, Utsunomiya; Takayuki Hayakawa, Nikko; Yasuo Kamiyama, Imaichi, all of Japan

[73] Assignee: Furukawa Electrical Company, Ltd., Tokyo, Japan

[21] Appl. No.: 750,215

[22] Filed: Jul. 1, 1985

[30] Foreign Application Priority Data

Jul. 9, 1984 [JP] Japan ..... 59-141973
Jul. 9, 1984 [JP] Japan ..... 59-141972

[51] Int. Cl.[4] ..... C25D 5/12; C25D 5/26; C25D 5/36

[52] U.S. Cl. ..... 204/34; 204/40; 428/670; 428/672; 428/673; 428/680

[58] Field of Search ..... 204/34, 40; 427/319; 428/670, 672, 673, 680

[56] References Cited

U.S. PATENT DOCUMENTS 3,546,080 12/1970 Iannone ..... 204/25
3,594,288 7/1971 Reinert ..... 204/34
3,645,861 2/1972 Garvey ..... 204/49
4,035,247 7/1977 Enomoto et al. ..... 204/19
4,422,906 12/1983 Kobayashi ..... 204/34
4,474,651 10/1984 Yauchi et al. ..... 204/34

FOREIGN PATENT DOCUMENTS 503008 3/1939 United Kingdom ..... 204/34

OTHER PUBLICATIONS

A. Kenneth Graham, "Electroplating Engineering Handbook, 3rd Ed., pp. 195–196 (1971).

*Primary Examiner*—G. L. Kaplan
*Attorney, Agent, or Firm*—Armstrong, Nikaido, Marmelstein & Kubovcik

[57] ABSTRACT

A process for metal plating a stainless steel comprising the first step of treating the stainless steel by a cathode electrolysis in an aqueous solution containing free HCl in an amount at least 30 g/l and at least one species of Ni and Co in an amount at least 0.1 g/l; the second step of metal plating the same by Ni or a Ni alloy in a weakly acidic Ni plating bath; and the third step of subsequently plating the same by a noble metal, Cu or an alloy thereof.

9 Claims, No Drawings

PROCESS FOR METAL PLATING A STAINLESS STEEL

DETAILED DESCRIPTION OF THE INVENTION

1. Field of the Invention

This invention relates to a process for metal plating a stainless steel (hereinafter referred to as SUS), which attains a high quality suitable for use in the precision machinery industries and electronics industries. Particularly, the products are most suitable for the noble metal plating use and can be utilized as contact points and connection part materials and the like.

2. Prior Art

SUS's are used for various purposes because they are generally in austenite systems, ferrite systems, deposition-cured systems, every one of which is excellent in physical characteristics including physical strengths and also in corrosion resistance due to the strong passive film formed on the surface. However, the formation of the passive film not only inhibit the junction characteristics to solders or brazing materials, but also causes a difficulty in electric connectings and, therefore, foreign metals especially noble metals, such as au, Ag, Pt, Pd, Ir and the like, are plated on them when they are used in precision machines and electronic instruments. These noble metals, which are excellent in corrosion resistance, are suitable for the soldering and electric connecting and are widely used in electric contact points, semiconductors and the like.

The formation of the passive films provides a considerable hinderance in the metal plating operation, and it is necessary to remove the passive films to activate the surface. As processes suitable for this purpose, there have been known a process in which a material to be metal-plated is immersed in a solution of HCl, $H_2SO_4$, or the like; a process for a further strong activation in which an electrolytic treatment is carried out in the solution using the material as a cathode and a process in which a Ni strike plating is applied. Usually, the plating is carried out after the Ni strike plating is applied.

As the former process, it is immersed in a solution containing 1.75 g/l of HCl and 10 g/l of $CH_3COOH$ at 30° C. for 5 to 10 minutes or is electrolyzed in a bath containing HCl in an amount of 100 g/l at 1A/dm$^2$ for 5 to 10 minutes to dissolve or reduce the passive film.

The Ni strike plating means, for example, a SUS material to be plated is treated as the cathode in an aqueous solution containing 240 g/l of $NiCl_2$ and 80 to 120 g/l of HCl at a current density of 20 A/dm$^2$ for 2 to 4 minutes to reduce the passive film by the electrolysis and simultaneously plating Ni on the SUS surface in a thickness of 0.4 to 1$\mu$ to protect the surface.

Problems to Be Solved by the Invention

There are problems when the SUS's which are plated by noble metals after they are strike plated by Ni, are used in precision machines or electronic instruments as follows. There are many cases in that it is difficult to plate them with metals after they are pressure molded as contacting elements for use as, for example, spring contacts such as of switches and connectors, because they are small in size and complex in form and, in addition, they are contained in structural bodies. Furthermore, it is also desired in view of the processability to process them by molding, after the SUS materials are previously plated. However, fine cracks tend to occur in the mold processing of the contacting elements, in which much processing, such as bending, extruding, drawing, and so on are involved.

These cracks are the cause of reductions in physical strengths and of changes in the electric contact resistance with the passage of time. This is because the Ni strike plating, accompanying the generation of a great amount of $H_2$ results in an inclusion of excess $H_2$ in the plated Ni layer which hardens the Ni layer and further causes generation of stresses with the result that cracks are generated in the plated Ni layer in the mold processing. On the other hand, the process as mentioned above, in which they are plated after being activated by a treatment involving a cathode electrolysis in an aqueous solution of HCl or $H_2SO_4$, has been performed for many years. However, products of this process are inferior to those of the Ni strike plating process in reliability, because the surface is oxidized during the moving from the activation to the metal plating, to again passivate. A process disclosed in Japanese unexamined patent publication No. 87296/1983 uses a special plating bath for this reason, in which plating bath special organic compounds, for example, a pyrrolidone derivative, acetylene glycohol homologues, a nonion surfactant and the like, are combined in an acidic bath. However, even in this process, not only is the generation of cracks inevitable, but also there is found the embrittlement in the SUS substrate itself. This is a class of hydrogen embrittlement caused by the nascent hydrogen generated in a considerable amount on the SUS surface and partly absorbed into the interior. This is remarkable in SUS's of the deposition cured systems of martensites. Further serious drawbacks are that adhesion characteristics degrade with the passage of time to promote, for example, the delamination of layers plated by Au on pressure molded articles from peripheral parts during long periods of use.

Means for Solving Problems

This invention is, as a result of various investigations to solve the drawbacks of the above mentioned conventional processes and to develop a process for metal plating a SUS which makes it possible to provide high quality platings of Cu and noble metals suitable for use in precision instruments and electronic instruments. This process comprises a noble metal plating of SUS's of, applying a cathodic electrolysis treatment to a SUS material to be plated in an aqueous solution containing at least 0.1 g/l of Ni or Co and at least 30 g/l of free hydrochloric acid, subsequently electrically plating Ni or a Ni alloy in a weakly acidic plating bath, and then conducting a plating with Cu or a noble metal.

That is to say, this invention is to apply the following processings to a SUS to be plated, before the plating. In addition, a treatment for degreasing or removing scales can be carried out before these treatments, when necessary.

The first processings is that a SUS material for use in plating is treated by a cathode electrolysis in an aqueous solution containing not less than 0.1 g/l of Ni or Co and not less than 30 g/l of free hydrochloric acid using a Fe 1~50% Ni or Co, such as a FeNi, FeCo, FeNiCo or SUS alloy as an anode, in which an electric current density of 1 to 100 A/dm$^2$ on the cathode and a processing time of 1 to 180 seconds are controlled within the range in relation to the bath composition.

The second processing is that the SUS material for use in the plating which has been processed in the first step is washed by water and is plated with Ni or a Ni alloy, for example, a Ni—Co (the Co content ranging from 5 to 20%), Ni—Zn, Ni—Fe, Ni—P (the P content ranging from 1 to 5%) or the like to a thickness of 0.05 to 0.5μ using a weakly acidic plating bath. As the weakly acidic plating bath, one such as a $NiSO_4$ bath, sulfamic acid bath, borofluoride bath or the like, which has a pH value of 2~4 is used.

The plating successively carried out after the above processing is done with Cu, the above mentioned noble metals or an alloy thereof, for example, PdNi, PdCo, AuCo, AuNi, AuSb, AuAgCu, PdAg, AgCu, AgZn, AgSb, CuNi, CuSn, CuZn, or the like in the conventional way.

Action

The SUS material to be plated is activated on the surface in the first step processing and at the same time, a micro amount of metal containing Ni or Co deposits which protects the SUS material on the surface, so it does not again convert to the passive state. However, if the amount of free hydrochloric acid is less than 30 g/l, not only the activation is insufficiently attained, but also the deposition of embrittled Ni occurs, which is disadvantageous. When the amount of Ni is less than 0.1 g/l, the suppression of the repassivation and the above mentioned hydrogen embrittlement is insufficient, and a stable adhesion of Ni plating layer can not be obtained. These amounts are desirably not less than 100 g/l of free hydrochloric acid and not less than 5 g/l of Ni. It is one of merits of SUS or Fe—1~50% Ni alloy, used as the anode in this processing, that the generation of a furiously poisonous $Cl_2$ gas is prevented, which $Cl_2$ gas is generated when an insoluble anode, such as carbon or Pt is used, but not when the Fe—1~50% Ni or Co alloy is used because it is soluble. Moreover, not only a supply of Ni or Co component is attained, but also the dissolved Fe or Cr simultaneously exerts unexpected effects. Namely, as contrasted with a single bath composition of HCl and $NiCl_2$ which gives a deposition of hard and thick Ni layer similar to that in the case of the conventional Ni strike plating, a Ni-rich layer of 300~300 Å thickness having Ni content of 10~60% given by the augean spectroscopic analysis is formed in a solution in which a SUS or Ni—Fe alloy is dissolved in a metallic concentration, for example, 20 g/l. The reason for this is not clear, but it is presumed that an excessive deposition of Ni or Co may be suppressed by the deposition of Ni-Fe alloy. Furthermore, the above mentioned Ni-rich layer effectively prevents the repassivation and makes it possible to provide a Ni or Ni alloy plaing which is excellent in adhesiveness in the second processing. A thin metal layer is deposited in the process of this invention, which results in little adsorption of hydrogen and the hydrogen embrittlement of SUS of a martensite system or deposition effect type can be suppressed. Reasons why an anode of Fe—1~50% Ni or Co is especically recommended in this application have been partly described above. The lower limit of Ni or Co is set forth as not less than 1%, because the cathodic deposition efficiency may have a lower value not more than 10% in many cases, as compared with the current efficiency of anodic dissolution which may be in a value near 100%. For this reason, Ni sufficiently in excess of the 50% Ni or Co results in a waste of expensive Ni or Co.

The second processing is to carry out the Ni or Ni alloy plating so there is no generation of cracks in the pressure molding or the like, and to suppress the delamination of Cu or a noble metal plated on the Ni or Ni alloy layer during long time periods of use. The Ni or Ni alloy plating layer, which has a hardness (Hv) of around 200 to 300 in any case, is soft and abundant in flexibility, as compared with a hardness (Hv) not less than 400 of the conventional Ni strike plating, which has a large amount of occluded hydrogen.

Delamination occurs in the above mentioned conventional articles plated by Cu or a noble metal when used for long periods. This is considered as a class of electric corrosion effects. In contrast to this, it is considered that the intermediate layer of this invention comprising Ni or a Ni alloy, which is positioned in the middle of a great electric potential difference between the active SUS and the layer of the noble metal or Cu, greatly suppresses the electric corrosion in the interface. The Ni or Ni alloy layer is practically set forth as not less than 0.05μ, and desirably ranging from 0.07 to 0.25μ, because the layer exceeding 0.5μ accelerates the generation of cracks.

The above mentioned Ni or Ni alloy plating layer is deposited from a bath having a pH ranging from 2 to 4, especially and desirably from 2.5 to 3.5. A pH exceeding the range results in the hardening and embrittlement due to the absorption of hydrogen, and the occlusion of a hydroxide of Ni and the like. The effects of this invention can be especially maximized when a bath containing Ni sulfamate as the main component is used, namely, a bath containing 200 to 600 g/l of Ni sulfamate and 10 to 50 g/l of $H_3BO_3$, and having a pH of 2 to 4.

As explained above, this invention has solved the disadvantages in the conventional noble metal or Cu plating on a SUS, in that the SUS is activated on the surface and temporarily protected at the same time by conducting a two step pretreatment in advance of the Cu or noble metal plating, so as to make it durable to a complexed mold preocessing and maintain high quality when used for a long period, of time by subsequently plating soft Ni or a Ni alloy followed by the plating. The plating can be applied, so as to give multilayers when necessary. For example, it can contribute to the improvement of the soldering and the adhesiveness of an Ag plating layer at a high temperature if Cu is plated for the first layer and Ag for the second layer. For another example, a first layer plated with Pd and a second thin layer plated with Au exert the equivalence of a thick Au plating layer in characteristics as contact points and have economic merits.

EXAMPLES

<1> SUS 310 of 0.12 mm thickness was used , and after this was degreased by acetone, the various processings shown in Table 1 were applied thereto. Then, noble metal platings were carried out to give layers of 1.0μ in thickness. The conditions of the plating baths indicated in this Table are shown in Tables 2 and 3. As to these samples, tests for the processability and the long term adhesiveness were carried out. Results are shown in Table 4.

The test for processability was carried out by extruding the work using pressure molds to prepare specimens of 8 mm in diameter and 0.3 mm and 0.6 mm in height. A part of them was subjected to the brine spraying test for 4 hours according to JIS (Japanese Industrial Standard) Z 2371 and then, the presence or absence of rust occurring on the processed part was visually observed. Some other parts were pressed on a Au plate by the pressure of 50 gG, where a DC is charged in a rate of 100 mA, to measure the electric contact resistance after they were kept in a moisture chamber at a temperature of 80° C. and a humidity of 95% for 1000 hours.

The adhesiveness was measured as follows:

Lines reaching the SUS substrates were cut by a cutter knife in a checkers figure having intervals of 1 mm on the specimens, which were then kept in a pressure cooker chamber at a temperature of 120° C. and humidity of 90% for 2000 hours. The delamination test was carried out according to JIS D 0202 method using an adhesion tape and the delamination situations of the plated parts were visually observed.

As it is obvious from Tables 1 and 2, cracks were generated by the pressure-processing to result in the significant generation of the rust, due to the brine and high contact resistance in Comparative Test No. 16, in which the strike plating by Ni was used, because the products were inferior in the processability. In contrast, it is seen from Examples 1 to 9 that the products of this invention were excellent in processability, prevented rust generation by the brine, showed low electric contact resistance, and no delamination of the noble metal layers was observed during long time periods of use.

TABLE 2-continued

| | |
|---|---|
| pH | 3.0 |
| Temperature of Bath | 55° C. |
| Current Density | 5 A/dm$^2$ |
| Bath B (Ni—10% Co Bath) | |
| $NiSO_4$ | 250 g/l |
| $NiCl_2$ | 30 g/l |
| $CoSO_4$ | 20 g/l |
| $H_3BO_3$ | 30 g/l |
| pH | 2.9 |
| Temperature of Bath | 55° C. |
| Current Density | 3 A/dm$^2$ |
| Bath C ($NiSO_4$ Bath) | |
| $NiSO_4$ | 250 g/l |
| $NiCl_2$ | 30 g/l |
| $H_3BO_3$ | 30 g/l |
| pH | 3.2 |
| Temperature of Bath | 50° C. |
| Current Density | 2.5 A/dm$^2$ |

TABLE 3

| | |
|---|---|
| Bath for Plating Au | |
| Bath N-40 (Manufactured by Japan Engelhalt Co.) | |
| Temperature of Bath | 55° C. |
| Current Density | 0.25 A/dm$^2$ |
| Bath for Plating Au | |
| AgCN | 60 g/l |
| KCN | 60 g/l |
| $K_2CO_3$ | 25 g/l |
| Temperature of Bath | 30° C. |

TABLE 1

| | | First Processing | | | | | | Second Processing | | | |
|---|---|---|---|---|---|---|---|---|---|---|---|
| | No. | HCl (g/l) | $NiCl_2$ (g/l) | Ni (g/l) | Anode | Current Density (A/dm$^2$) | Time (Min.) | Plating Bath | Plating Metal | Thickness (μ) | Metal Plating |
| Present Invention | 1 | 100 | — | 11 | SUS 301 | 5 | 0.5 | Bath A | Ni | 0.25 | Au |
| Present Invention | 2 | 100 | — | 19 | SUS 301 | 5 | 0.5 | Bath A | Ni | 0.25 | Au |
| Present Invention | 3 | 100 | — | 6 | SUS 301 | 5 | 0.5 | Bath A | Ni | 0.1 | Au |
| Present Invention | 4 | 45 | — | 5 | SUS 631 | 12 | 0.5 | Bath B | Ni—10% Co | 0.08 | Ag |
| Present Invention | 5 | 35 | — | 0.2 | Fe—5% Ni | 2.5 | 2.0 | Bath C | Ni | 0.075 | Ag |
| Present Invention | 6 | 35 | — | 0.8 | Fe—5% Ni | 2.5 | 2.0 | Bath C | Ni | 0.15 | Ag |
| Present Invention | 7 | 100 | — | Co 1.5 | SUS 301 | 5 | 0.5 | Bath C | Ni | 0.15 | Pd |
| Present Invention | 8 | 100 | — | Co 7.5 | Fe—5% Co | 1.5 | 0.5 | Bath A | Ni | 0.5 | Au |
| Present Invention | 9 | 100 | — | — | Fe—15% Co | 1.5 | 0.5 | Bath A | Ni | 0.5 | Ag |
| Comparative Test | 10 | 120 | — | — | Pt | 5 | 1.0 | Bath C | Ni | 0.15 | Au |
| Comparative Test | 11 | 100 | — | 0.07 | Pt | 5 | 1.0 | — | — | — | Au |
| Comparative Test | 12 | 120 | — | 16 | Pt | 5 | 1.0 | Bath C | Ni | 0.15 | Au |
| Comparative Test | 13 | 15 | — | 11 | SUS 304 | 5 | 1.0 | Bath C | Ni | 0.15 | Au |
| Comparative Test | 14 | 100 | — | 11 | SUS 301 | 5 | 0.5 | Bath A | Ni | 0.01 | Au |
| Comparative Test | 15 | 100 | — | 11 | SUS 301 | 5 | 0.5 | Bath A | Ni | 0.75 | Au |
| Comparative Test | 16 | 120 | 240 | — | Ni | 10 | 0.05 | — | — | — | Au |

TABLE 2

| | |
|---|---|
| Bath A (Sulfamic Acid Bath) | |
| $Ni(SO_4NH_2)_2$ | 500 g/l |
| $NiCl_2$ | 25 g/l |
| $H_3BO_3$ | 30 g/l |
| Current Density | 2 A/dm$^2$ |
| Pd-20Ni Plating Bath | |
| Bath PNP-80 (Manufactured by Nisshin Chemical Co., Ltd.) | |
| Temperature of Bath | 25° C. |
| Current Density | 0.5 A/dm$^2$ |

TABLE 4

| | No. | Generation of Rust by the Brine: Height of 0.3 mm | Generation of Rust by the Brine: 0.6 mm | Electric conduct Resistance (mΩ): Height of 0.3 mm | Electric conduct Resistance (mΩ): 0.6 mm | Adhesiveness: Before the Test | Adhesiveness: After the Test |
|---|---|---|---|---|---|---|---|
| Present Invention | 1 | No generation | No generation | 5.9 | 6.6 | No delamination | No delamination |
| Present Invention | 2 | No generation | No generation | 6.1 | 7.1 | No delamination | No delamination |
| Present Invention | 3 | No generation | No generation | 5.4 | 5.3 | No delamination | No delamination |
| Present Invention | 4 | No generation | No generation | 12.0 | 11.0 | No delamination | No delamination |
| Present Invention | 5 | No generation | No generation | 13.0 | 11.0 | No delamination | No delamination |
| Present Invention | 6 | No generation | No generation | 11.0 | 14.0 | No delamination | No delamination |
| Present Invention | 7 | No generation | No generation | 6.9 | 9.1 | No delamination | No delamination |
| Present Invention | 8 | No generation | No generation | 5.8 | 6.9 | No delamination | No delamination |
| Present Invention | 9 | No generation | No generation | 13.5 | 13.0 | No delamination | No delamination |
| Comparative Test | 10 | No generation | No generation | 7.7 | 7.4 | A little delamination | Existence of delamination |
| Comparative Test | 11 | No generation | No generation | 6.9 | 6.8 | A little delamination | Existence of delamination |
| Comparative Test | 12 | No generation | No generation | 6.7 | 7.1 | A little delamination | Existence of delamination |
| Comparative Test | 13 | A little generation | Much generation | 59.0 | >100 | A little delamination | A little delamination |
| Comparative Test | 14 | No generation | No generation | 5.1 | 5.2 | No delamination | Existence of delamination |
| Comparative Test | 15 | A little generation | Much generation | 14.2 | 25.0 | No delamination | No delamination |
| Comparative Test | 16 | Much generation | Much generation | >100 | >100 | No delamination | No delamination |

In further contrast, the delamination of noble metal layers generated during the long time periods of use in every case of Comparative Test No. 10, in which the Ni plating was carried out after the conventional electrolytic activation, of Comparative Test No. 11, in which Au was plated without the Ni plating after the same activation, of Comparative Test No. 12, in which Ni content was less than 0.1 g/l in the cathode treatment, and of comparative Test No. 14, in which the Ni plating layer was less than 0.5μ in thickness after the cathode treatment. It was seen that products were inferior in with processability in Comparative Test No. 13, in which the content of free hydrochloric acid was less than 30 g/l in the cathode treatment, as well as in Comparative Test No. 15, in which Ni plating layer was more than 0.5μ in thickness after the cathode treatment.

By the way, in Comparative Test Nos. 10 and 11, which were of classes of the conventional processes, the adhesiveness was already insufficient even immediately after the plating.

<2> Example Nos. 1 and 8 of Example <1> and also comparative Test Nos. 11 and 14 for the comparison were repeated, in which a Cu plating of 1μ was carried out instead of the final Au plating using a bath containing:

CuCN
KCN
NaOH

The products were tested in the same way as to the adhesiveness. Results were shown in Table 5.

No delamination was generated in Examples of this invention but, in contrast, the delamination was generated in the passage of time in the every case of Comparative Test Nos. 18 and 19, corresponding to the conventional examples.

TABLE 5

| | No. | Pre-Treatments Before the Metal Plating | Adhesiveness: Before the Test | Adhesiveness: After the Test |
|---|---|---|---|---|
| Example of the Present Invention | 16 | The same as in No. 1 | No delamination | No delamination |
| Example of the Present Invention | 17 | The same as in No. 8 | No delamination | No delamination |
| Comparative Test | 18 | The same as in No. 11 | No delamination | Existence of delamination |
| Comparative Test | 19 | The same as in No. 14 | No delamination | Existence of delamination |

<3> SUS 631 (Hv.510) or use as a spring having thickness of 0.08 mm was used. This material was subjected to the various treatments shown in Table 6 after it was electrolytically degreased with NaOH. Various tests were carried out as to the product and the results shown in Table 7 were obtained.

In the Tables, the repeated bending was sought by that the test specimens, in a tape figure of 5.0 mm in width, were put between the holding parts of a tool giving the bending diameter of zero, and fixed and that after a load of 750 gr was attached at the other end, the tape was repeatedly bent alternatively to the left and right giving each right angle to count the times to rupture. The processed specimens which were the same as in the above <1> were kept at 40° C. for 48 hours in a chamber having 200 ppb of $NO_2$, 100 ppb of $H_2S$, 300 ppb of $Cl_2$ and 75% of hydrogen and maintained at 40° C. to measure the electric contact resistance and the measurement was carried out in the same way. As to the adhesiveness, the test was the same as in <1>.

In contrast, in No. 23, in which the current density of the first step of this invention was excessively increased, the decrease in the repeating times of bending was significant and, in addition, the rapid increase in the electric contact resistance was caused by the cracks formed in the pressure-processing. It is presumed that these are results of the absorption of large amounts of hydrogen and the deposition of hard metal alloy layers.

<4> (Experimental Examples

TABLE 6

| | | First Step | | | | | | | Second Processing | | | |
|---|---|---|---|---|---|---|---|---|---|---|---|---|
| | No. | HCl (g/l) | $NiCl_2$ (g/l) | Ni (g/l) | Co (g/l) | Anode | Current Density ($A/dm^2$) | Time (second) | Metal Plating Bath | Plating Metal | Thickness (μ) | Metal Plating |
| Present Invention | 17 | 150 | — | 6 | — | SUS 631 | 50 | 10 | A | Ni | 0.5 | Au |
| Present Invention | 18 | 15 | — | 16 | — | Fe—25 Ni | 25 | 25 | " | " | " | " |
| Present Invention | 19 | 120 | — | 5 | 2.5 | Fe—30 Ni—15 Co | " | " | " | " | " | " |
| Comparative Test | 20 | 150 | — | — | — | Pt | 2.0 | 90 | — | — | — | " |
| Comparative Test | 21 | — | — | — | — | Pt | " | " | A | Ni | 0.02 | " |
| Comparative Test | 22 | 120 | — | 5 | 2.5 | Fe—30 Ni—15 Co | 30 | 0.5 | " | " | 0.5 | " |
| Comparative Test | 23 | " | — | " | " | " | 150 | 9.0 | " | " | " | " |
| Comparative Test | 24 | 120 | 120 | — | — | Ni | 1.5 | 60 | — | — | — | " |

TABLE 7

| | | Repeated Bending (Times) | | Electric Conduct Resistance (μ) | | Adhesiveness | |
|---|---|---|---|---|---|---|---|
| | No. | Before the Test | After the Test | The Height of 0.3 mm | 0.6 mm | Before the Test | After the Test |
| Present Invention | 17 | 530 | 500 | 8.1 | 8.6 | No delamination | No delamination |
| Present Invention | 18 | " | 500 | 8.7 | 8.0 | No delamination | No delamination |
| Present Invention | 19 | " | 510 | 8.5 | 9.6 | No delamination | No delamination |
| Comparative Test | 20 | " | 390 | 75 | 22 | A little delamination | Existence of delamination |
| Comparative Test | 21 | " | 410 | 70 | 30 | A little delamination | Existence of delamination |
| Comparative Test | 22 | " | 530 | — | — | Delamination | — |
| Comparative Test | 23 | " | 410 | >100 | >100 | No delamination | No delamination |
| Comparative Test | 24 | " | 440 | >100 | >100 | No delamination | No delamination |

The Results of the adhesiveness are obvious as in the above stated <1> and <2>.

In No. 22, in which processing time of the first step of this invention was insufficient, the failure of good adhesion occurred at the finishing of the plating. In Comparative Test Nos. 20 and 21, in which the conventional electrolylic activation was carried out, the repeating times of the bending were greatly reduced, because SUS 631 was a SUS of the deposition cured type having a martensite system. This was caused by the hydrogen embrittlement. In Comparative Test No. 24 of the Ni-strike plating, this value was considerably reduced. However, this was caused by the hard Ni plating layer (about 1μ) which generated cracks on the surface rather than by hydrogen embrittlement. In contrast, this reduction stayed at low levels in the Examples of this invention. The same may be obvious from the above as to the electric contact resistance.

In order to investigate causes of the difference in the adhesiveness measured immediately after the metal plating in the above Example <3>, samples which were obtained immediately after the first steps in Nos. 17, 19 and 20 were washed with water and dried. After 4 hours, they were subjected to the AES(Auge Electron Analysis) to assay the surface depth, from which analysis of oxygen in the depth of repassivated films were actually measured to give the values of 15, 12 and 65Å, respectively. It may be obvious that the repassivation remarkably proceeds in the conventional process, as compared with the process of this invention.

Merits of the Invention

As explained above, metal plated SUS's which are excellent in processability and have good adhesiveness, can be produced according to this invention and, therefore, this invention exerts industrially remarkable effects, such that the hinderance in quality and performance, which heretofore has caused problems when the materials are used in precision instruments or electronic instruments.

What is claimed is:

1. A process for metal plating a stainless steel material comprising (1) a first step of subjecting the stainless steel material to an electrolysis treatment using the stainless steel material as a cathode in an aqueous solution consisting essentially of free HCl in an amount at least 30 g/l and at least one species of Ni and Co ions in an amount at least 0.1 g/l; (2) a second step of metal plating the same by Ni or an alloy of Ni in a weakly acidic Ni plating bath; and (3) a third step subsequently plating the same by a noble metal or an alloy thereof.

2. The process as set forth in claim 1, wherein the aqueous solution contains at least one species of Ni and Co ions in an amount ranging from 0.1 to 15 g/l.

3. The process as set forth in claim 1, wherein a ferroally containing at least one species of Ni and Co in an amount ranging from 1 to 50% is used as an anode in the electrolysis treatment of the first step.

4. The process as set forth in claim 3, wherein a stainless steel is used as the anode.

5. The process as set forth in claim 3, wherein the electrolysis treatment of the step 1 is carried out at a current density on the cathode being in a range of 1 to 10 $A/cm^2$ and for a time ranging from 1 to 180 seconds; and a plating bath having a pH value ranging from 2 to 4 is used as the bath for plating Ni or an Ni alloy.

6. The process as set forth in claim 1, wherein the electrolysis treatment of the step 1 is carried out at a current density of the cathode being in a range from 1 to 100 $A/dm^2$ and for a time ranging from 1 to 180 seconds.

7. The process as set forth in claim 1, wherein a plating bath having a pH value ranging from 2 to 4 is used in the second step.

8. The process as set forth in claim 7, wherein a plating bath containing Ni sulfamate as the main component is used.

9. The process as set forth in claim 1, wherein a plating layer of Ni or an Ni alloy is formed, whereby the plating layer is maintained in a thickness ranging from 0.05 to 0.5$\mu$ in the second step.

* * * * *